United States Patent [19]

Fevig et al.

[11] Patent Number: 5,022,720

[45] Date of Patent: Jun. 11, 1991

[54] DISPLAY CASE

[75] Inventors: Robert J. Fevig; Randall S. Holleman, both of Grand Haven, Mich.; Duane L. Seaver, N. Muskegon, all of Mich.

[73] Assignee: Structural Concepts Corporation, Spring Lake, Mich.

[21] Appl. No.: 516,443

[22] Filed: Apr. 30, 1990

[51] Int. Cl.[5] ..... A47B 51/00

[52] U.S. Cl. ..... 312/223; 362/125; 108/107; 108/138; 312/116

[58] Field of Search ..... 108/107, 138; 312/116, 312/223, 236; 362/125

[56] References Cited

U.S. PATENT DOCUMENTS

| | | | |
|---|---|---|---|
| D. 139,202 | 8/1944 | Beaudry . | |
| D. 198,891 | 8/1964 | Milstein . | |
| D. 202,081 | 8/1965 | Zaslovsky et al. . | |
| D. 209,722 | 12/1967 | Mangini . | |
| D. 268,069 | 3/1983 | Milstein . | |
| D. 281,844 | 12/1985 | Waldeck . | |
| D. 294,315 | 2/1988 | Jakubowski . | |
| 946,337 | 1/1910 | Glear . | |
| 1,554,137 | 9/1925 | Slifkin . | |
| 1,758,976 | 5/1930 | Rice . | |
| 1,805,989 | 5/1931 | Levene | 108/107 X |
| 3,894,634 | 7/1975 | Gotham et al. . | |
| 3,981,511 | 9/1976 | Foster . | |
| 3,986,758 | 10/1976 | Heaney | 312/236 |
| 4,017,130 | 4/1977 | Hanson . | |
| 4,489,995 | 12/1984 | Barr . | |
| 4,531,646 | 7/1985 | Howard . | |
| 4,535,705 | 8/1985 | Soulakis | 108/107 X |
| 4,627,542 | 12/1986 | Fredrickson . | |
| 4,660,477 | 4/1987 | Kortering et al. | 108/108 |
| 4,689,726 | 8/1987 | Kretzschmar | 312/223 X |
| 4,689,726 | 8/1987 | Kretzschmar . | |
| 4,730,073 | 3/1988 | Bartus et al. . | |

OTHER PUBLICATIONS

Arctica Display Systems, "Discover a New Perspective in Food Display Systems, Discover Arctica!"(2 pp. double sided) undated.

Arctica Display Systems, "Discover a New Perspective in Food Display Systems, Discover Arctica!" (1 p. double sided) undated.

Sig Greenebaum Inc., "The Smallest Details Make the Biggest Difference", undated.

The Columbus Show Case Company, "Simplicity of Design Elegance of Form", undated.

The Columbus Show Case Company, "Profiles".

The Columbus Show Case Company, No Title, "Fresh Bakery is Presented in the Best of Taste by Cosmopolitan Line of . . . ", undated.

Federal Industries, "Curved Glass Case", Model CG-61, undated.

Federal Industries, "Curved Glass Case", Model CG-6150, undated.

Hill Refrigeration Corporation, "Bakery Showcase", undated.

Hussmann Corporation, "Curved Glass Bakery Merchandisers", undated.

Maier, "World-Proven Plans for Increasing Your Sales", undated.

Maier, ". . . das Erfolgaskonzept fur Ihren Mehrumstatz, " undated.

Regal Custom Fixtures Company, Inc., "Bakery Double'", undated.

Regal Custom Fixtures Company, Inc., "Bakery Continental", undated.

Regal Custom Fixtures Company, Inc., "Bakery Larond", undated.

(List continued on next page.)

*Primary Examiner*—Joseph Falk

*Attorney, Agent, or Firm*—Warner, Norcross & Judd

[57] ABSTRACT

A display case with adjustable shelves each having a light fixture to better showcase the goods supported therein. The shelves are both vertically and angularly adjustable. The power outlets within the case are slidably supported in a vertical raceway to be movable into proximity which their corresponding shelves to minimize power cord exposure.

11 Claims, 5 Drawing Sheets

OTHER PUBLICATIONS

Royal Food Display Systems, "Introducing the Royal-Horizon", undated.
Royal-Quality Crafted Food Display Systems, "The Royal Horizon Bakery Collection", undated.
The C. Schmidt Company, "Schmidt Eurocase, System II", undated.
The C. Schmidt Company, "Schmidt Eurocase, HiV", undated.
Structural Concepts Corporation, "Structa Series", undated.
Structural Concepts Corporation, "Structa Curved Glass Bakery Merchandisers", undated.
Tyler Refrigeration Corporation, "Curved Glass Bakery", undated.
Warren/Sherer, "Model B4V (C) (U)", undated.
Wescho, "New Concepts for Sales Success", undated.
Wescho, "Wescho Will Bring Your Sales Success," undated.

DISPLAY CASE

BACKGROUND OF THE INVENTION

The present invention pertains to display cases, and in particular, to cases with illuminated shelves.

Bakery cases are typically large enclosures having a plurality of vertically stacked shelves to support the baked goods. Unilluminated shelves are often vertically adjustable to vary the spacing between the shelves. In illuminated cases, each shelf is provided with a light fixture to illuminate the goods supported below it.

Although the use of adjustable shelves and light fixtures are both desirable, their combination in a case has heretofore been aesthetically displeasing. Specifically, power for the light fixture is supplied through a cord which is secured to an electrical outlet in the rear of the case. With respect to a fixed shelf construction, the cord and plug can be substantially hidden from view by stringing the cord along the under surface of its corresponding shelf and inserting the plug into a receptacle adjacent the rear of the shelf. However, vertically adjustable shelves frequently cause the cords to droop or otherwise be exposed between the shelves as the cords extend between the light fixture and an unaligned receptacle.

The shelves of display cases can generally be adjustably positioned in either a horizontal or inclined orientation at a fixed height. As can be appreciated, this lack of adjustment limits the usefulness and versatility of the case for the end user.

SUMMARY OF THE INVENTION

In accordance with the present invention, a display case is provided with a unique shelving and lighting construction that obviates the aforementioned problems and provides greatly expanded capabilities.

In a first aspect of the invention, the display case includes vertically adjustable shelves provided with light fixtures. The electrical outlets within the enclosure are movably mounted along a vertical raceway, so that they can be vertically adjusted along with the shelves. This construction avoids the unsightly stringing of cords between the shelves by enabling the electrical cords, supplying power to the light fixtures, to be hidden along the bottom of the shelves irrespective of the shelves' vertical positions.

In a second aspect of the invention, the display case includes a support construction for mounting shelves in different angular orientations. Moreover, the support construction effects the angular adjustment without a loss of vertical adjustment. This increased versatility greatly increases the usefulness of the device for the end consumer.

These and other objects, advantages, and features of the present invention will be more fully understood and appreciated by reference to the specification and drawings.

DETAILED DESCRIPTION OF THE PREFERRED EMBODIMENT

Figure 1:
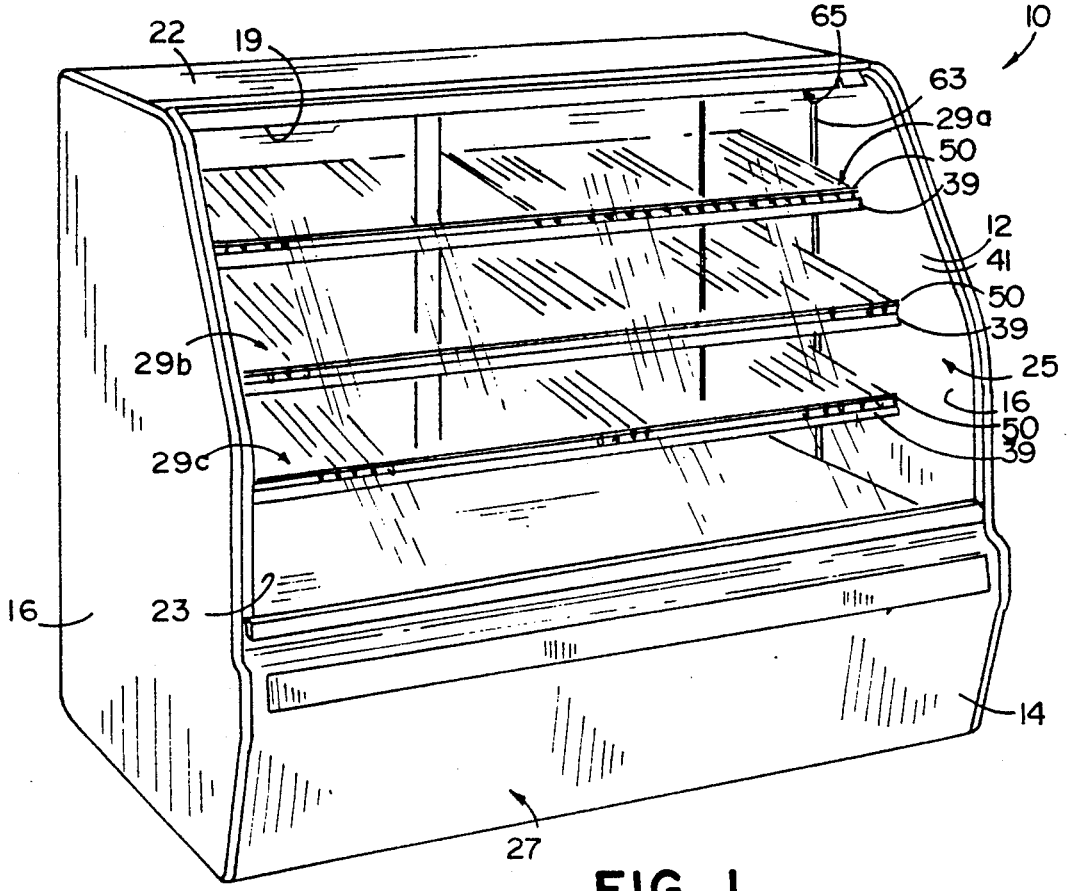
FIG. 1 is a perspective view of the display case of the present invention.

In the preferred embodiment, a display case 10 (FIGS. 1 and 10) includes a number of enclosure components including a front transparent door 12, a front panel 14, a pair of sidewalls 16, a pair of rear sliding doors 19, a top panel 22, and a rear panel (not shown) opposite the front panel. These components collectively define an enclosure which is subdivided by a deck 23 to define an upper display space 25 and a lower housing space 27. In general, display space 25 is provided with a plurality of vertically stacked shelves 29 on which the goods (not shown) are supported. Housing space 27 is unseen by the consumers and is intended to house electrical and mechanical devices, such as ballasts for the light fixtures and refrigeration equipment if any.

Figure 10:
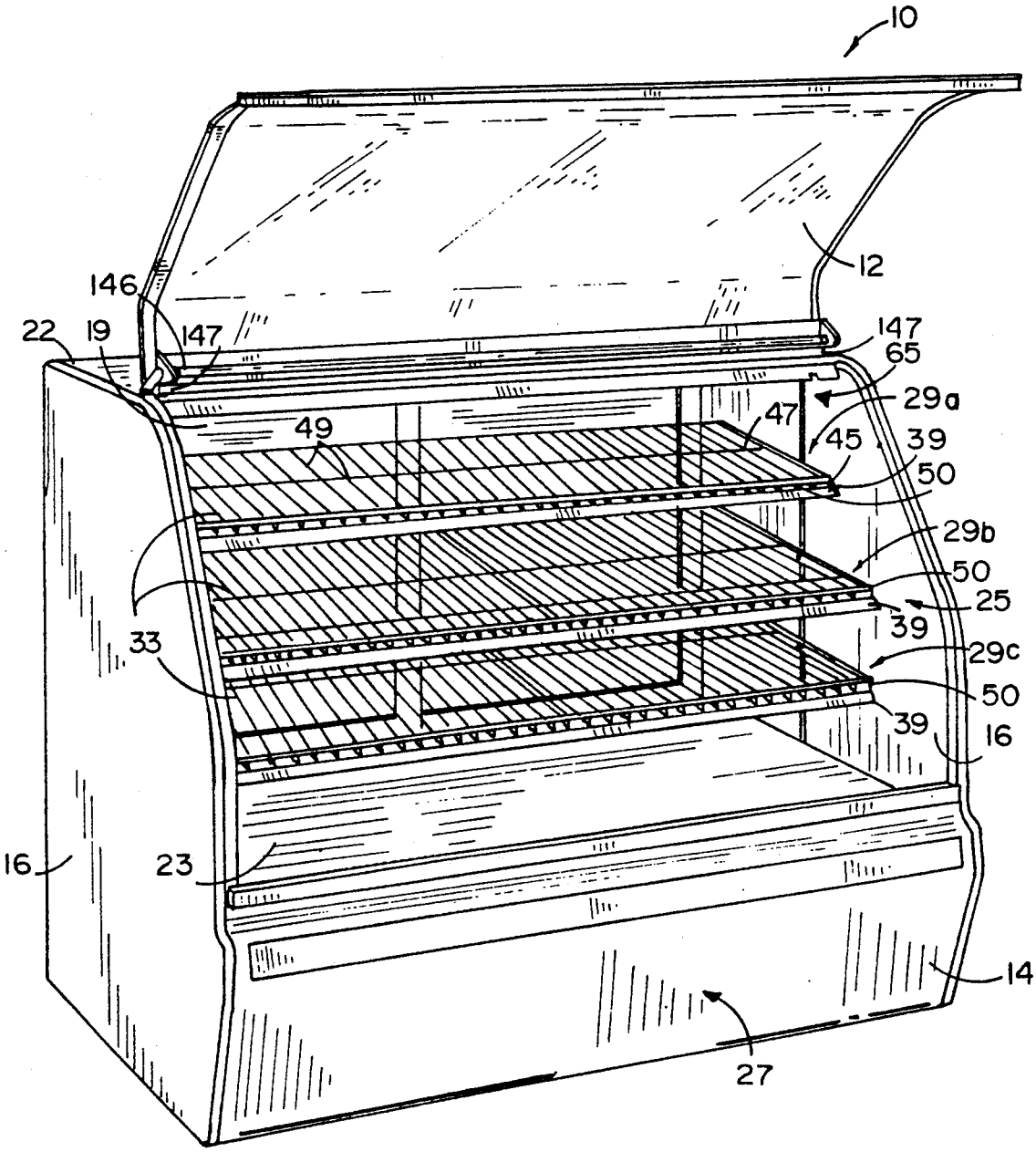
FIG. 10 is a perspective view of the display case with the front transparent panel in its open position.

In the illustrated embodiment, three shelves 29*a*, 29*b*, 29*c* are provided within display space 25 (FIGS. 1 and 10). Of course any reasonable number of shelves could be used. Shelves 29 are illustrated as the wire rack type. However, other types of shelves, such as glass, could be used.

Figure 2:
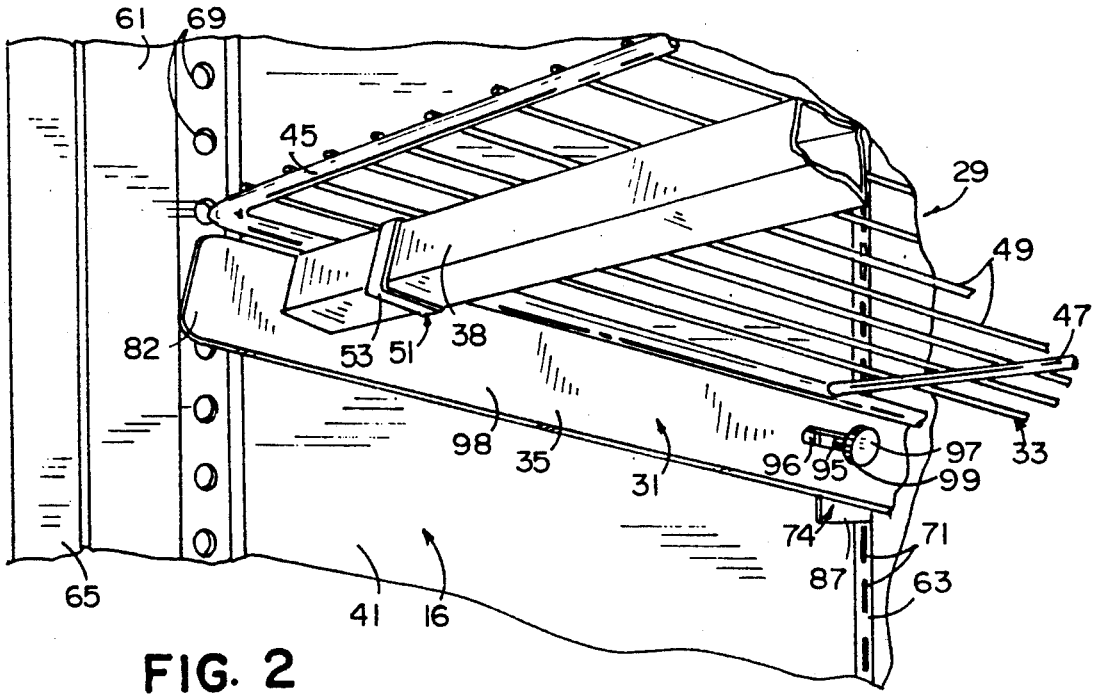
FIG. 2 is a fragmentary perspective view of an inclined shelf mounted to side of the case.
Figure 3:
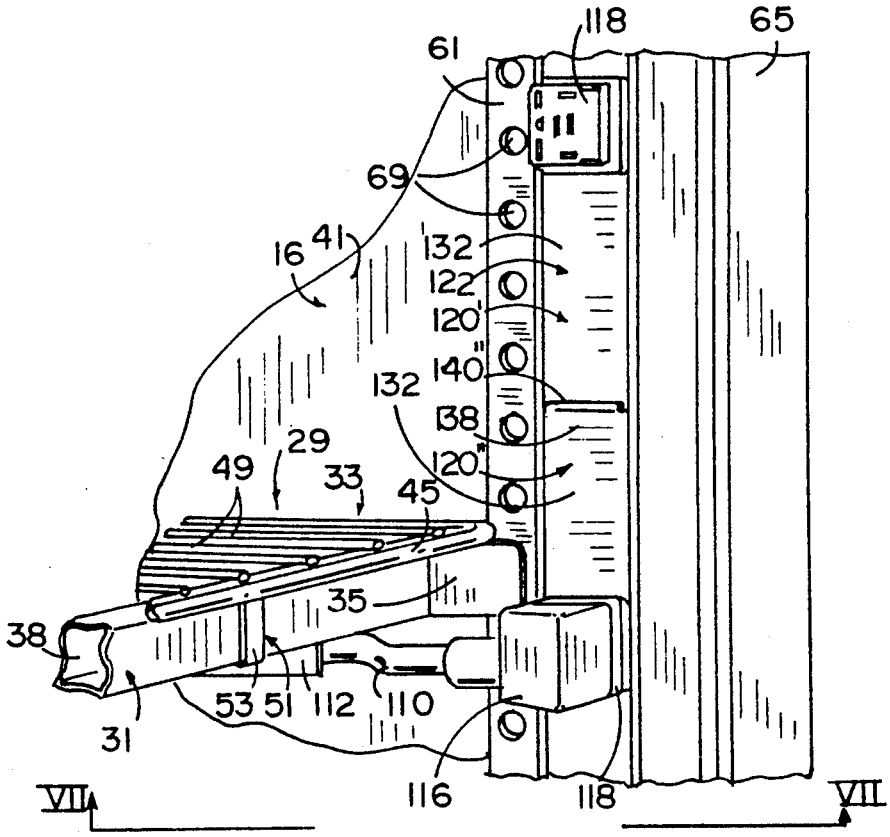
FIG. 3 is a fragmentary perspective view of the electrical arrangement of the display case.

In general, shelves 29 are comprised of a framework 31 and a rack portion 33 (FIGS. 2 and 3). Framework 31 includes a pair of spaced apart side rails 35, a rear supporting bar 38, and a front light fixture 39 (FIGS. 2–6). Side rails 35 are positioned closely adjacent and substantially parallel to the inner surfaces 41 of sidewalls 16. Supporting bar 38 interconnects the opposite rear ends of rails 35. Light fixture 39 (FIGS. 1, 5–6 and 10) includes a housing 40 that functions as a structural support for the front of framework 31. Specifically, housing 40 interconnects the front ends of side rails 35. A separate structural member may be used if a non-structural light fixture is to be employed.

Wire racks 33 (FIGS. 1–3, 7 and 10) provide the support for the goods (not shown). Racks 33 each includes a generally rectangular frame 45 having a medial rod 47, and a plurality of parallel support rods 49 to support the goods thereon. Support rods 49 typically extend from back to front in a generally parallel relationship with sidewalls 16. A raised lip 50 is defined by rods 49 along the front of the racks 33. Lip 50 supports the goods against sliding forwardly off the shelf when the shelf is placed in an inclined orientation. A pair of clips 51 (FIG. 2) are used to attach wire racks 33 to bar 38. In particular, each clip includes a segment 53 which is wrapped about supporting bar 38 and a segment (not shown) wrapped about a connecting bar 57 affixed transversely by welding or the like to rods 49.

The inner surfaces 41 of each sidewalls 16 are each provided with a rear mounting strip 61 and an intermediate mounting strip 63 (FIGS. 2–4 and 6). As will be described more fully below, these strips 61, 63 interact with shelf mounting elements 73, 74 to not only support shelves 29, but also to facilitate the height and angular adjustment of shelves 29. Rear mounting strips 61 are mounted in the rear corners 65 of display case 10, whereas intermediate mounting strips 63 are positioned approximately midway between the rear and front portions of case 10.

Mounting strips 61, 63 (FIGS. 2–4 and 6) are each provided with an aligned row of openings 69, 71, respectively thus forming mounting tracks. Openings 69 are preferably a series of small round holes arranged in a substantially vertical line. Openings 71 are preferably in the form of elongated rectangular slots adapted to receive hooks 77 movably secured to frame 45 of shelves 29. The shapes of openings 69, 71, however, could be modified to suit different mounting elements on shelves 29.

The rear mounting elements 73 (FIGS. 2–6) of shelves 29 are outwardly projecting pin members. Specifically, a pin 73 is fixed to the rear end 82 of each side rail 35 to project outwardly from its outer face 79. Pins 73 are received within holes 69 to provide rear supports for shelves 29.

The other shelf mounting elements 74 (FIGS. 4 and 5) are essentially L-shaped brackets having base sections 87 and mounting sections 89. Base section 87 is a plate member having a single threaded stud 93 projecting therefrom. Mounting section 89 projects outwardly from base section 87, in an opposite direction from stud 91, and defines along its free end a pair of vertically spaced hooks 77. Hooks 77 are adapted to be received within slots 71 and lowered into an engaged position. Stud 93 includes a threaded shank 95 that extends through slot 96 in side rail 35 to movably couple bracket 74 to frame 31. A nut member 97 is threadedly received on shank 95. Preferably, nut 97 is adhered to stud 93 through the use of a conventional adhesive. Nut 97 includes an enlarged knob portion having a roughened surface 99 to facilitate easy adjustment of the bracket.

In use, the frame 31 for each shelf 29 is assembled into its proper position. More specifically, side rails 35 are initially mounted within the case without rear bar 38 and light fixture 39. Once rails 35 are in place, bar 38 and fixture 39 are assembled into their positions to form frame 31. Bar 38 and light fixture 39 are attached to rails 35 through conventional snap-fit coupling elements or other known fasteners (not shown). To adjust the position of a shelf 29, bar 38 and fixture 39 are removed and rails 35 repositioned. Thereafter, bar 39 and light fixture 39 are reattached as before.

Figure 4:
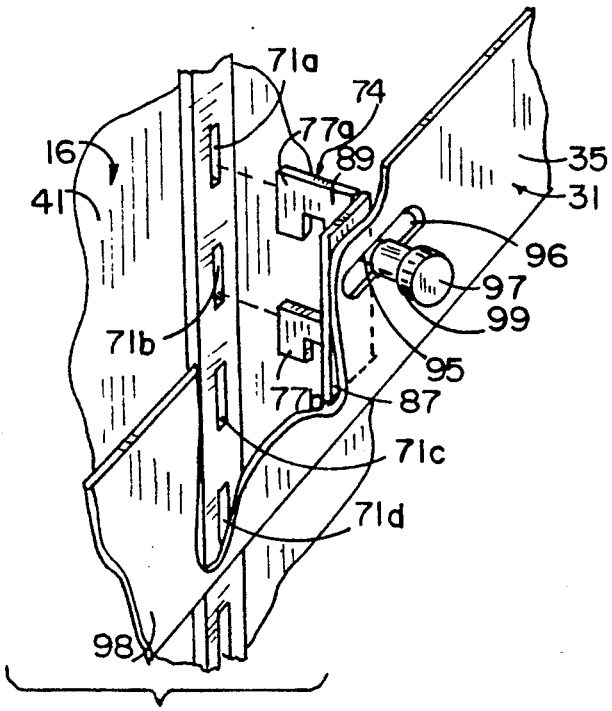
FIG. 4 is a fragmentary perspective view of one of the intermediate supports for the shelves.
Figure 5:
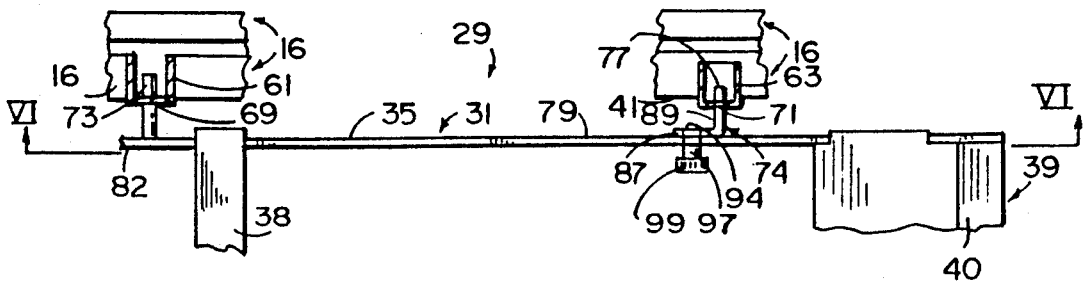
FIG. 5 is a fragmentary cross-sectional view taken along line V—V in FIG. 6, with the wire rack omitted for clarity.
Figure 6:
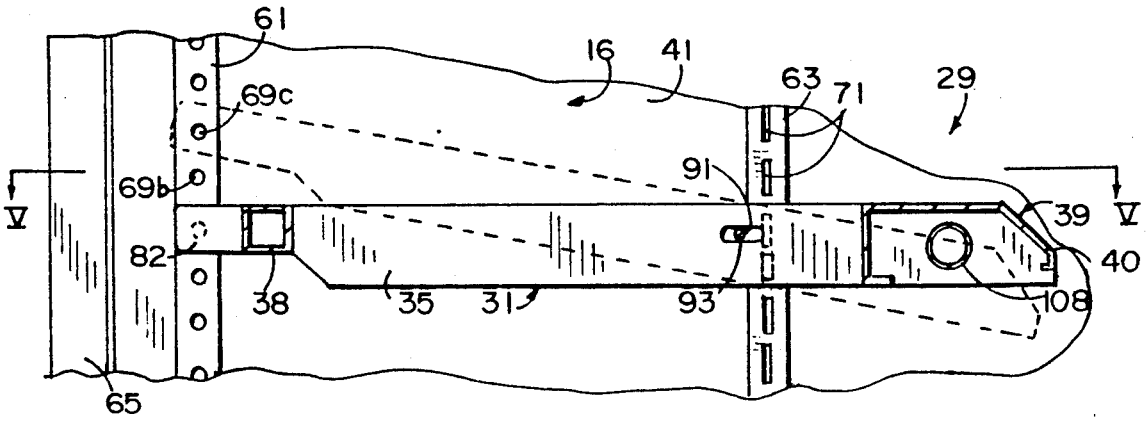
FIG. 6 is a fragmentary cross-sectional view taken along line VI—VI in FIG. 5, with an inclined orientation of the shelf being shown in phantom and the wire rack being omitted for clarity.

In the preferred embodiment, shelves may be placed in a horizontal position, a five degree inclination, or a ten degree inclination. The inclined orientation of a shelf 29 is achieved by inserting the hooks 77 of brackets 74 in slots 71 which are not aligned with the corresponding holes 69 for pins 73. For instance, to move the shelf from a horizontal position to a five degree position, the hooks 77 of brackets 85 are removed from their first set of slots and shifted downward such that they are each received in the next aligned slot. As illustrated in FIG. 4, hook **71*a* is removed from slot 71*a* and inserted within slot 71*b* and hook 77*b* is removed from slot 71*b* and inserted within slot 71*c*. To place the rack at a 10 degree orientation, the hooks are merely moved another slot downwardly, such that hook 77*a* is placed in slot 71*c* and hook 77*b* is placed in slot 71*d*. In all of these positions, pins 73 remain in the same holes 69 and act as a pivot point for the shelves. Of course, if a different vertical position was additionally desired, pins 73 would also be moved along with bracket 74. Alternatively, pins 73 could be moved to different holes 69*b* or 69*c*, while leaving brackets 74, to incline shelf 29 (FIG. 6). The arcuate movement of frame 31 relative to stud 93, experienced in changing a shelf's inclination, is compensated by slot 96. Hence, as the shelf is inclined the side rail 35 moves relative to stud 93 within slot 96**. Moreover, the five and ten degree orientations are merely chosen as examples. The shelves may, in fact, be placed at any desired inclination and may include more than three different positions.

Light fixtures 39 are generally well known to those having skill in the art and are each positioned along the front of one of the shelves 29 (FIGS. 1, 6 and 10). Light fixture 39 is directed downwardly to illuminate the goods placed on the shelf 29 or deck 23 directly below it. For instance, light fixture **39*a* is intended to primarily illuminate the goods placed upon shelf 29*b*. Typically, conventional fluorescent lamps 108 are used in the light fixtures 39**. Of course other types of lighting arrangements could be used.

Figure 7:
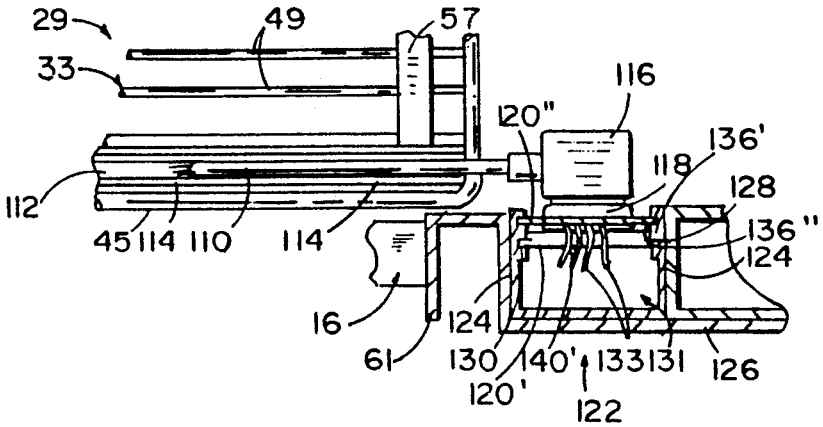
FIG. 7 is a fragmentary cross-sectional view taken along line VII—VII in FIG. 3.

An electrical cord 110 supplies power to light fixture 39 (FIGS. 3 and 7). Cord 110 is hidden from the casual observer to enhance the aesthetic appearance of case 10. More specifically, each shelf 29 is provided with a channel portion 112 (FIGS. 3 and 7) which opens generally downwardly and has a width substantially equal to the diameter of cord 110. Channel portion 112 is preferably a plastic U-shaped member which is secured to the underside of rack 33. Cord 110 is frictionally held within channel 112 to ensure that it does not fall or droop downwardly in an unsightly manner. An electrical plug 116, which is adapted to be matingly received into an electrical outlet 118, is provided on the rear end of cord 110.

Display case 10 is provided with a plurality of electrical outlets 118 or other electrical connectors to supply power to light fixtures 39 (FIGS. 3 and 7–9). In general, the number of outlets provided will equal the preferred number of shelves to be used in the case. Of course, any number of outlets could be provided.

In any event, outlets 118 are mounted upon carriage plates 120 slidably received within a raceway 122 (FIGS. 3 and 7–9). Raceway 122 is a substantially U-shaped member having a pair of outstanding legs 124 and an interconnecting bight 126. The free ends of each leg 124 are provided with a pair of adjacent substantially parallel slots or tracks 128, 130. Tracks 128, 130 are adapted to slidably receive the various plates 120 therein. The fixed ends of legs 124 and bight 126 collectively define a channel 131 through which wires 133 for outlets 118 are passed. In the preferred embodiment seven wires are coupled to each outlet 118.

In particular, plates 120 mounting outlets 118 are divided into inner plates 120' and outer plates 120''. Each plate 120', 120'' has a generally rectangularly shaped body 132 and a rectangularly shaped opening 134 in which outlet 118 is securely mounted. Each body 132 is provided with a pair of side edges 136 and ends 138. Side edges 136 are each slidingly received within one of the tracks 128, 130. Specifically, side edges 136' of inner plates 120' are matingly received within the inner tracks 128 defined in legs 124 for sliding movement. Likewise, side edges 136'' of outer plates 120'' are matingly received within the outer tracks 130 of legs 124 for sliding movement. In this way, each outlet 118 can be slidingly moved for vertical adjustment in raceway 122 to correspond to any vertical adjustment of the light fixture it powers. This adjustability enables each outlet 118 to be slid into juxtaposition with its corresponding shelf 29 to thereby conceal it somewhat from view. Outlets 118 are maintained in their desired position through frictional forces. Specifically, the friction developed between plates 120 and tracks 128, 130, and that created by the collection of the numerous wires (not shown) extending through raceway 122, function to hold outlets 118 in place. This frictional force is quite small, though, and is easily overcome through manual movement of the outlets.

Figure 8:
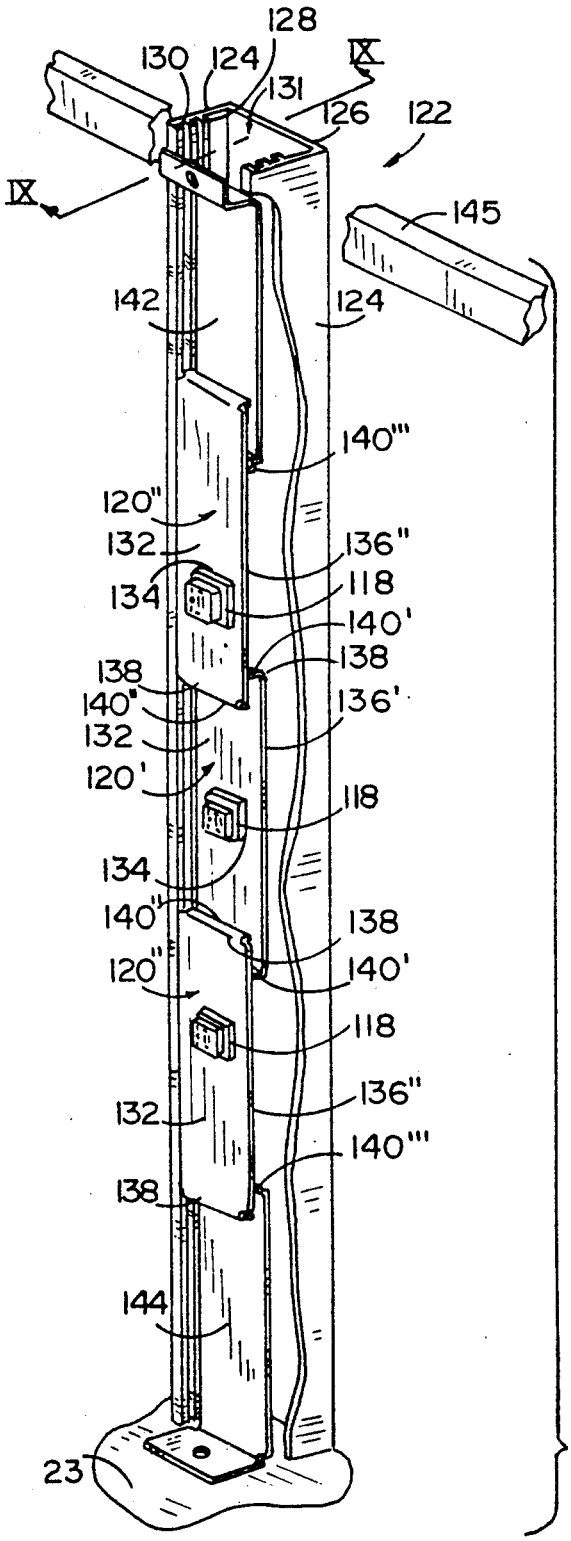
FIG. 8 is a fragmentary perspective view of the electrical outlet assembly.
Figure 9:
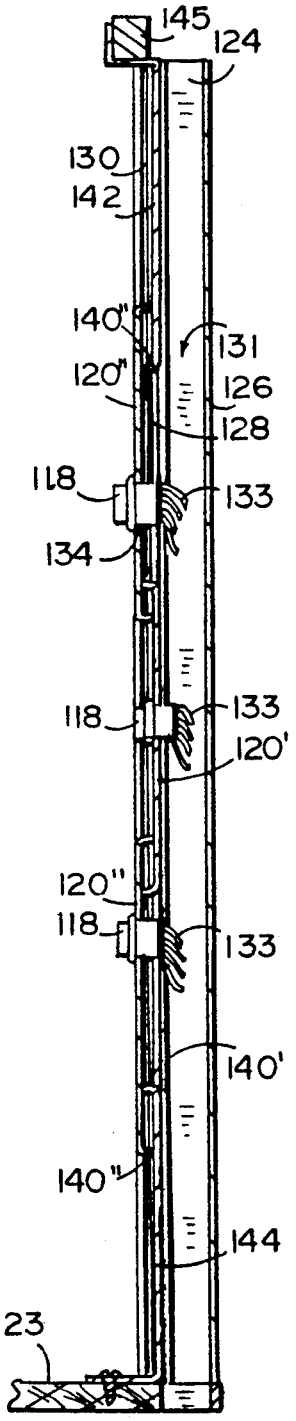
FIG. 9 is a fragmentary cross-sectional view taken along lines IX—IX in FIG. 8.

The ends 138 of each plate 120 are provided with stops 140 (FIGS. 8 and 9). Stops 140 are oriented to interact with one another and prevent any unsightly and hazardous gaps from developing in raceway 122. In particular, inner plates 120' are provided with outwardly projecting stops 140', and outer plates 120'' are provided with inwardly projecting stops 140''. Due to the overlap of inner and outer plates 120', 120'', stops 140' abut and engage stops 140'' when the adjacent outlets 118 are moved to their extreme separated positions.

Raceway 122 is further provided with a pair of end plates 142, 144 (FIGS. 8 and 9). Top end plate 142, in the illustrated embodiment, is received within inner track 128. Top plate 142 is preferably bolted or otherwise secured to a frame member 145 in the top of the case. Bottom end plate 144, in the illustrated embodiment, is also mounted in the inner track 128. Bottom plate 144 is preferably bolted or otherwise secured to deck 23. Since these plates 142, 144 are mounted in inner tracks 128, their ends adjacent to outlets 118 are provided with outwardly projecting stops 140' which operate in the same way as stops 140' for plates 120' Plates 142, 144 could of course also be positioned in tracks 130 and provided with stops 140''.

As best seen in FIG. 10, front door 12 is optionally hinged to top panel 22 to facilitate cleaning and maintenance. Door 12 is provided with a light fixture 146 adapted to illuminate the goods provided on top shelf 29*a*. Also, to ease the opening of door 12 and hold it in its upright position, each side includes a pair of conventional gas springs 147 mounted within side walls 16.

The above description is that of a preferred embodiment of the invention. Various alterations and changes can be made without departing from the spirit and broader aspects of the invention as set forth in the appended claims, which are to be interpreted in accordance with the principles of patent law including the Doctrine of Equivalents.

The embodiments of the invention in which an exclusive property of privilege is claimed are defined as follows:

1. A display case comprising:

a housing defining an enclosure;

a plurality of shelves adapted to support items thereon for display;

a plurality of light fixtures, each of said light fixtures attached to one of said shelves;

first means for movably supporting said plurality of shelves within said enclosure at a plurality of different vertical locations;

a plurality of electrical outlets for supplying power to each of said plurality of light fixtures;

second means for movably mounting said outlets within said enclosure so that each of said outlets can be positioned in proximity to an associated one of said shelves, said second means comprising:

a raceway within said enclosure defining a plurality of generally vertically extending tracks;

a plurality of carriage members disposed ian vertical adjacency along said raceway, each of said carriage members carrying at least one of said electrical outlets, said tracks including means for vertical slidable support of said carriage members therealong, each of said carriage members having an end edge portion disposed overlapping the end edge portion of a vertically adjacent carriage member so that no unsightly and hazardous gaps are created in said raceway.

2. A display case as defined in claim 1 wherein each of said overlapping end portions of said carriage members includes a stop element projecting in a direction toward the adjacent carriage member such that said stops of adjacent carriage members are adapted to abut one another and prevent adjacent carriage members from creating gaps therebetween.

3. A display case as defined in claim 1 wherein said first means further includes means for supporting said plurality of shelves at a plurality of different angular inclinations.

4. A display case comprising:

a housing defining an enclosure and having spaced apart sidewalls;

at least one shelf within said enclosure on which items can be displayed, said shelf extending between said sidewalls and having spaced apart shelf ends;

a framework for supporting said shelf, said framework including spaced apart side rails disposed adjacent said shelf ends and said sidewalls;

a first pair of mounting track means, each of said first pair having a generally vertically extending series of openings disposed along one of said sidewalls adjacent a first extent of one of said side rails;

a second pair of mounting track means, each of said second pair having a generally vertically extending series of openings disposed along one of said sidewalls spaced apart from said first pair and adjacent a second extent of one of said side rails;

a pair of mounting elements, each of said elements affixed to a said side rail first extent projecting outwardly therefrom and selectably engaging one of said openings of the adjacent first mounting track means thereby to support the first extent of said side rail at a desired vertical location;

a pair of brackets, each of said brackets disposed between one of said second pair of mounting track means and the adjacent side rail, each of said brackets having first and second engagement elements, said first engagement elements engaging at least one of said openings of the adjacent second mounting track means, said second engagement element supporting said side rail second extent and having means to permit relative linear movement therebetween along the length of said side rail to support said second extent at plural vertical locations independently of the engagement of said pair of mounting elements with said first mounting track means.

5. The display case of claim 4 further comprising a longitudinal slot formed in said second extent of each of said side rails, each of said second engagement elements comprising a stud means slidably engaging said slot.

6. The display case of claim 5 wherein said stud means comprises a threaded shank extending through said slot and a nut means threaded on said shank.

7. The display case of claim 4 wherein said second mounting track means is disposed forwardly of said first mounting track means.

8. The display case of claim 4 further comprising at least one light fixture attached to said at least one shelf, at least one electrical outlet for supplying power, and means for movably mounting said outlet within said enclosure so that said outlet can be positioned in proximity to said shelf in plural vertical locations.

9. The display case of claim 8 wherein said means for movably mounting said outlet comprises a generally vertically extending raceway within said enclosure and a carriage member carrying said outlet, said raceway including means for vertical slidable support of said carriage therealong.

10. The display case of claim 9 further comprising a plurality of said shelves, a plurality of said light fixtures attached to said plurality of shelves, a plurality of outlets for supplying power, and a plurality of said carriage members, each of said carriage members carrying one of said outlets, said carriage members disposed in vertical, slidable adjacency along said raceway, each or said carriage members having an end edge portion disposed overlapping the end edge portion of a vertically adjacent carriage member so that no unsightly and hazardous gaps are created in said raceway.

11. The display case of claim 10 wherein each of said overlapping end portions of said carriage members includes a stop element projecting in a direction toward the adjacent carriage member such that said stops of adjacent carriage members are adapted to abut one another and prevent adjacent carriage members from creating gaps therebetween.

* * * * *

UNITED STATES PATENT AND TRADEMARK OFFICE

CERTIFICATE OF CORRECTION

PATENT NO. : 5,022,720

DATED : June 11, 1991

INVENTOR(S) : Robert J. Fevig et al

It is certified that error appears in the above-identified patent and that said Letters Patent is hereby corrected as shown below:

Claim 1, Column 6, Line 9
"ian" should be --in--

Signed and Sealed this

Thirteenth Day of October, 1992

*Attest:*

DOUGLAS B. COMER

*Attesting Officer*

*Acting Commissioner of Patents and Trademarks*